US005862637A

United States Patent [19]

Bruce

[11] Patent Number: 5,862,637

[45] Date of Patent: Jan. 26, 1999

[54] ROOF SCREEN SYSTEM

[75] Inventor: Ryan W. Bruce, Scotts Valley, Calif.

[73] Assignee: Royal Roofing Co., Inc., San Jose, Calif.

[21] Appl. No.: 909,020

[22] Filed: Aug. 11, 1997

[51] Int. Cl.[6] ..... E04H 12/20

[52] U.S. Cl. ..... 52/147; 52/146

[58] Field of Search ..... 52/712–713, 146, 52/127.2, 147, 741.4; 248/351; 256/12.5; 135/87

[56] References Cited

U.S. PATENT DOCUMENTS

| | | | |
|---|---|---|---|
| D. 243,853 | 3/1977 | Ejchorszt | D25/2 |
| 3,817,006 | 6/1974 | Williams | 52/122 |
| 4,016,691 | 4/1977 | Cale | 52/298 |
| 4,068,427 | 1/1978 | Camardo | 52/127.2 |
| 5,040,344 | 8/1991 | Durand | 52/127.2 |
| 5,228,262 | 7/1993 | Meriwether | 52/704 |
| 5,481,836 | 1/1996 | Miller | 52/127.2 |
| 5,622,021 | 4/1997 | Bookout | 52/582.1 |
| 5,660,006 | 8/1997 | Emerson | 52/127.2 |

*Primary Examiner*—Carl D. Friedman
*Assistant Examiner*—Beth A. Aubrey
*Attorney, Agent, or Firm*—Robert Charles Hill

[57] ABSTRACT

A roof screen system for securing a roof screen to a roof is provided. The system includes a plurality of mounting units that are secured to the roof by means of cylindrical supports. A weatherproofing assembly is disposed about each support and its base to prevent the roof from leaking, due to mounting of the supports on the roof. The weatherproofing assembly includes a collar that extends around the support to prevent water from flowing down the support and to a base cover that inhibits water from collecting on the base to prevent the roof from leaking. The cylindrical configuration of the support and weatherproofing assembly coact to prevent water and debris from collecting about the support and its base, to aid with maintaining roof integrity and to prevent the roof from leaking. Each mounting unit comprises a plurality of braces affixed in a triangular relationship. The triangular relationship of the braces aids with supporting the roof screen in the presence of extreme natural forces. The braces comprise a strong, lightweight, and weather resistant material to prolong the life expectancy of the invention and to prevent the mounting units from failing in the presence of natural forces, such as wind and earthquakes. The roof screen is provided with a weather resistant coating to enhance the wear resistant properties and aesthetics of the screen during the life thereof.

16 Claims, 3 Drawing Sheets

62
68
70
58
46
40
44
52
28
56
54
42
34
38
26
74
72
76
30
20
24
76
62
60

22
76
64
68
70
66
46
28
58
44
28
36
52
54
26
40
40

ROOF SCREEN SYSTEM

BACKGROUND OF THE INVENTION

1. Field of the Invention

The present invention relates generally to roofing construction systems, and more particularly, to an improved roof screen system.

2. Description of Related Art

Roof screen systems are used for concealing from view roof mounted equipment or changing the appearance of a building by changing its roof line. Today, these systems are most often used to conceal from view roof mounted heating, ventilating, and air conditioning systems, commonly referred to as HVAC systems, or other structures that protrude above the roof line of a commercial building and detract from the aesthetics thereof.

An example of a prior art roof screen system for securing a roof screen, or parapet, to a roof is shown in FIG. 1 and FIG. 2 of the drawings. In the prior art, a roof screen or parapet 1, that often comprises a plurality of modular panels, is secured to a roof 2 using a conventional mounting system 3 comprising a plurality of mounting units 4. Each mounting unit includes a pair of sleepers 5, which typically comprise wood, that are secured to the roof 2 with bolts 6 for example. Each unit further includes a base brace 7 that is attached to the sleepers and may be secured to the parapet, and a diagonal brace 8 that is secured to the base brace and parapet, for securing the parapet to the roof. A plurality of the mounting units are spatially positioned along the parapet to secure the screen to the roof.

A disadvantage of prior art roof screen mounting systems is that the sleepers are tightly bolted through the roof, which commonly causes the roof to leak. Another disadvantage of the prior art, is that since the sleepers are tightly bolted to the roof, there may be a slight depression in the roof surrounding the sleeper. Often debris 9, such as leaves or other debris, and water accumulate around the sleeper, causing further leaking of the roof and potentially damaging the roof. Additionally, since the prior art components of the mounting systems typically comprise wood, such as the braces of each unit, the braces can break in the presence of extreme natural forces, such as high winds or earthquakes, causing the system to fail.

Thus, there exists a need for a roof screen system that effectively secures the roof screen to the roof without causing the roof to leak and that will not fail in the presence of extreme natural forces.

OBJECTS OF THE INVENTION

It is therefore an object of the present invention to provide an improved roof screen system;

It is another object of the present invention to provide an improved roof screen mounting system that secures a roof screen to a roof without causing the roof to leak;

It is a further object of the present invention to provide an improved roof screen mounting system that does not fail in the presence of extreme natural forces;

It is still another object of the present invention to provide an improved roof screen mounting system that is strong and lightweight;

It is yet a further object of the present invention to provide an improved roof screen mounting system that is weather resistant; and It is another object of the present invention to provide an improved roof screen mounting system that includes a weather resistant roof screen.

SUMMARY OF THE INVENTION

These and other objects and advantages of the present invention are achieved by providing an improved roof screen system. The roof screen system of the present invention includes a plurality of mounting units for securing a roof screen, or parapet, to a roof. In the preferred embodiment, each of the mounting units is secured to the roof by means of a pair of cylindrical supports.

A weatherproofing assembly is disposed about each support and its base to prevent the roof from leaking, due to mounting of the supports on the roof. The weatherproofing assembly preferably comprises a collar that extends around the cylindrical support and is secured thereto to prevent water from flowing down along the support and over its base, potentially causing the roof to leak. The weatherproofing assembly further includes a body portion coupled to the collar and to a base cover that protects the support's base. The body portion extends along the support to protect the support from weather, such as by preventing water from contacting the support, while the base cover inhibits water from collecting on the base to prevent the roof from leaking and to inhibit damage to the roof. Additionally, the cylindrical configuration of the support, weatherproofing assembly's body portion, and base cover all coact to prevent water and debris from collecting about the support and its base to aid with maintaining roof integrity, particularly to prevent the roof from leaking.

Each mounting unit of the present invention further comprises a plurality of braces including a base brace, a vertical brace, and a diagonal brace. In the preferred embodiment, the base brace is affixed to the cylindrical supports for securing the mounting unit to the supports and thus to the roof A lower end of the vertical brace is affixed to an outer end of the base brace, and the diagonal brace is affixed to an inner end of the base brace and to an upper end of the vertical brace, such that the diagonal brace extends obtusely between the two braces forming a triangular relationship between the braces. The triangular relationship of the braces aids with supporting a roof screen panel coupled to the vertical brace for supporting the roof screen. Each of the braces preferably comprises a strong and lightweight, and weather resistant material to increase the life of the present invention, while preventing the mounting units from failing in the presence of extreme natural forces. In the preferred embodiment, the braces comprise elongated portions of angle iron that are fabricated using a galvanized metal alloy, such as galvanized steel. The braces are coupled together using appropriate methods, such as welding for example.

The vertical brace is preferably provided with means for securing the roof screen, or parapet, to the mounting unit to secure the roof screen to the roof. A plurality of mounting means, such as standoffs, are affixed to the vertical brace and are provided with bolts, or other means for coupling the roof screen to the brace, for securing the screen to the mounting unit. In the preferred embodiment, the roof screen comprises a multiplicity of suitably dimensioned screen panels, as discussed above, that are provided with a weather resistant coating. The weather resistant coating preferably comprises KYNAR or other well known Polyvinylidene fluoride, that prevents weather damage from coming to the panels, to maintain and enhance the appearance of the roof screen.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes presently contemplated by the inventor of carrying out the invention. Various modifications, however, will remain readily apparent to those skilled in the art, since the generic principles of the present invention have been defined herein.

Figure 1:
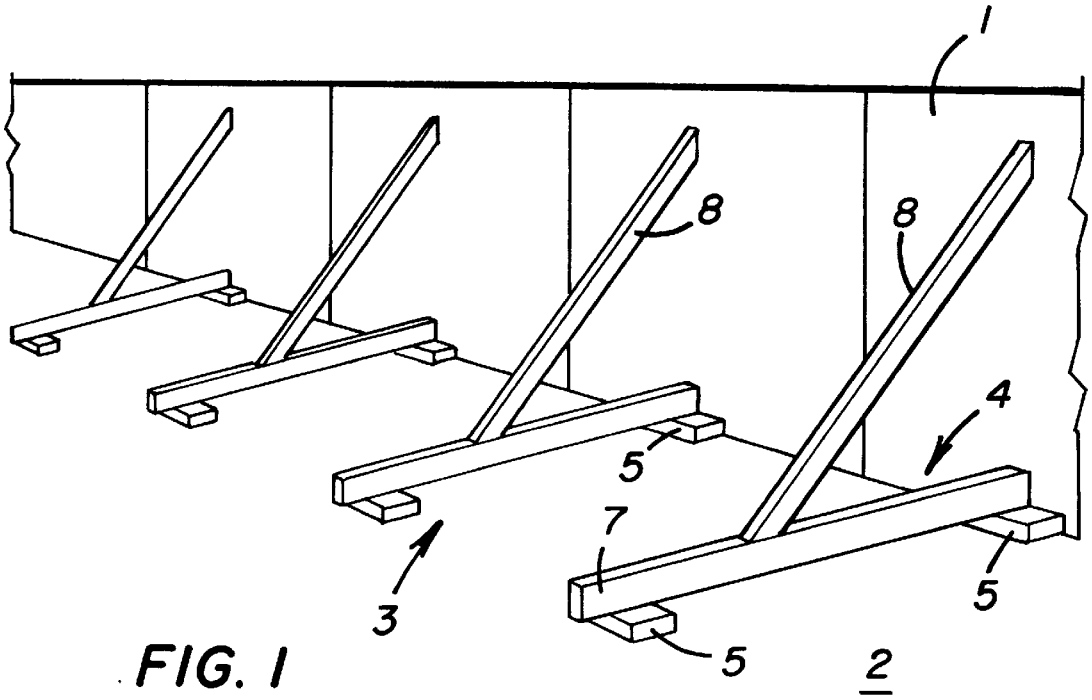
FIG. 1 PRIOR ART
FIG. 1 is a perspective view of a prior art roof screen mounting system.
Figure 2:
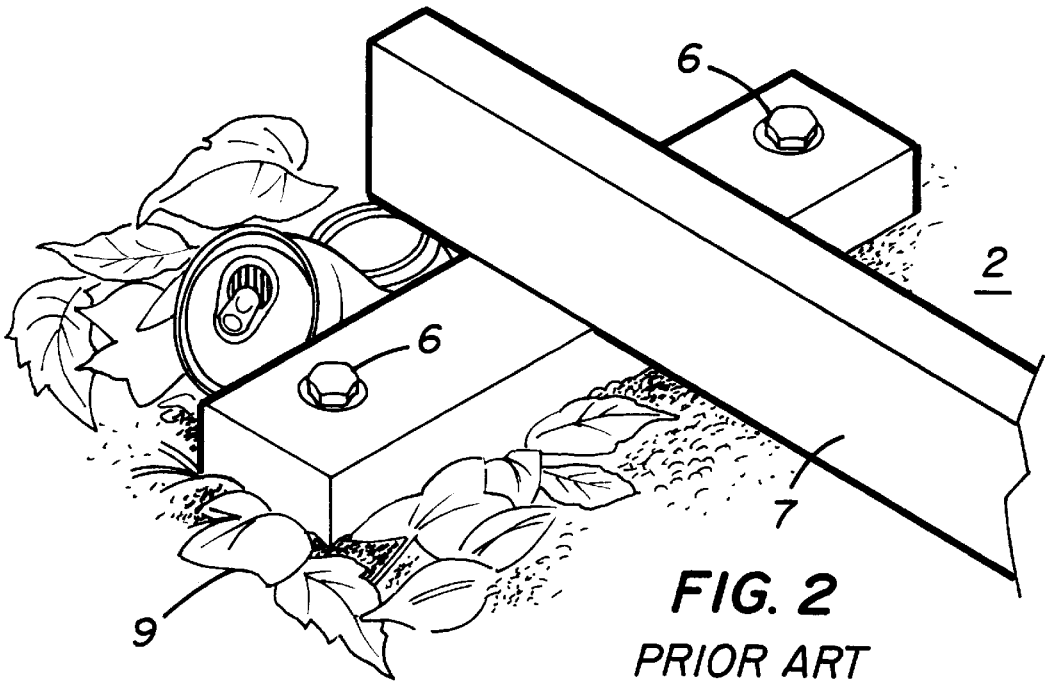
FIG. 2 PRIOR ART
FIG. 2 is a perspective, fragmentary view of the prior art roof screen mounting system.
Figures 3, 4:
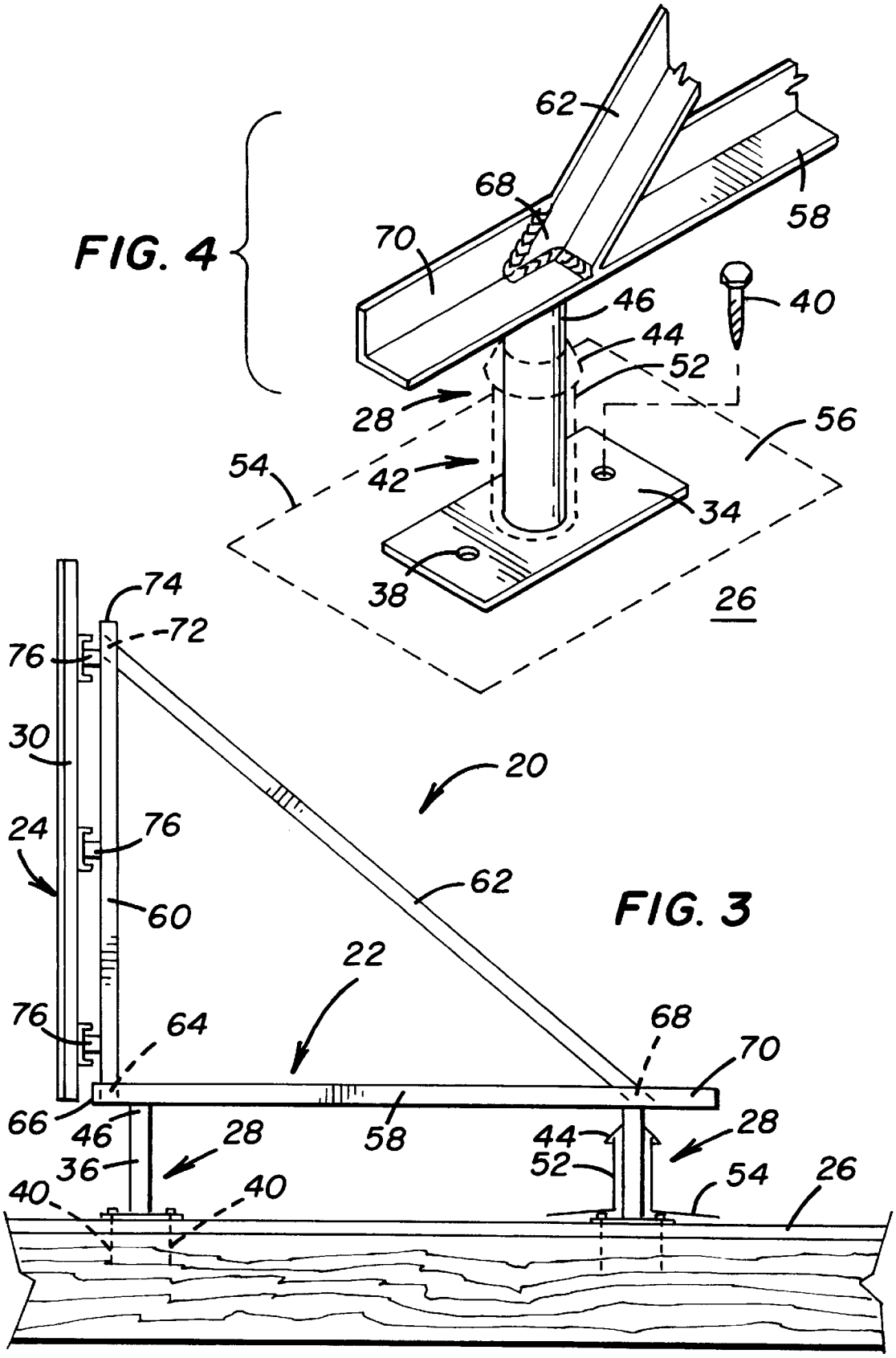
FIG. 3 is a schematic, side elevational view of a preferred embodiment of a roof screen system of the present invention.
FIG. 4 is a schematic, perspective view of a preferred embodiment of a support for a mounting unit of the roof screen system of the present invention.
Figure 6:
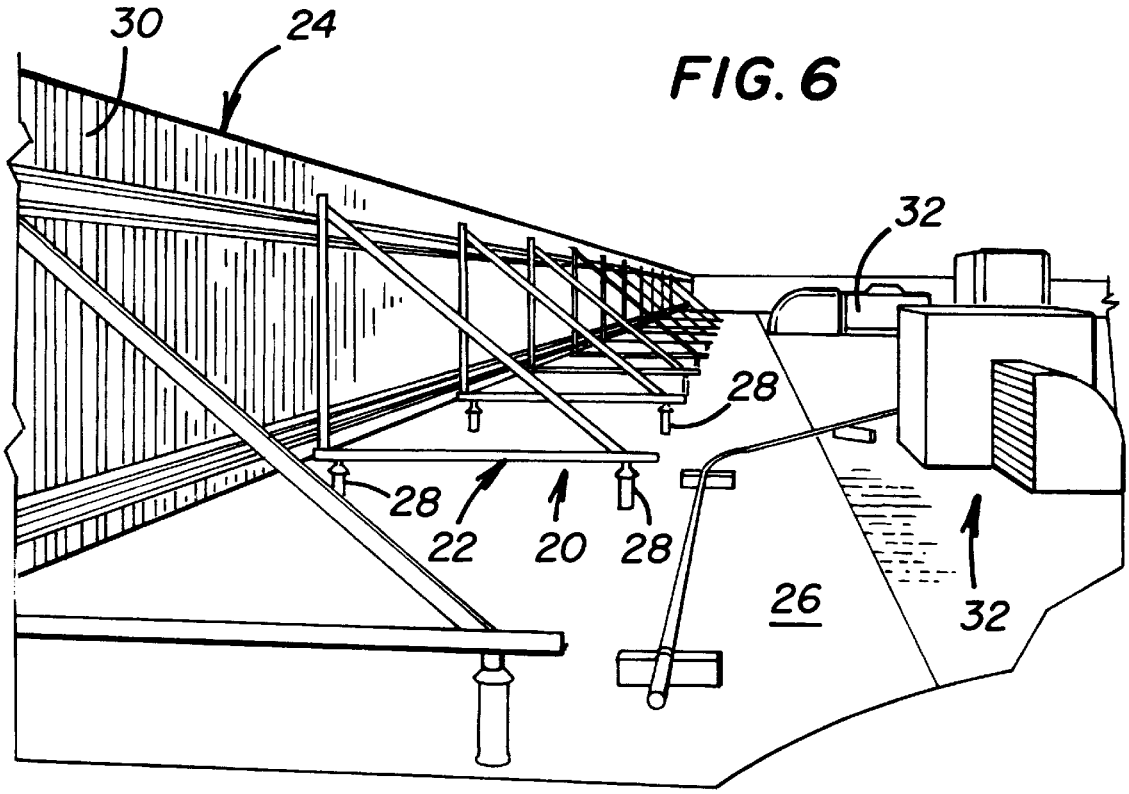
FIG. 6 is a perspective view of showing the preferred embodiment of the roof screen system of the present invention securing a roof screen to a roof.

Referring now to FIG. 3 and FIG. 6 of the drawings, there is shown generally at 20, a preferred embodiment of a roof screen system constructed according to the principles of the present invention. The invented system 20 includes a plurality of mounting units 22 for securing a roof screen 24 or parapet, to a roof 26. The mounting units 22 are spatially positioned along the screen 24, to secure the screen 24 to the roof 26. In the present invention 20, each of the mounting units 22 is secured to the roof 26 by means of a pair of preferably cylindrical supports 28.

In the preferred embodiment, the roof screen 24 may comprise a multiplicity of suitably dimensioned screen or face panels 30 that are interconnected using methods known in the art. The panels 30 are preferably dimensioned to conceal from view roof mounted heating, ventilating, and air conditioning systems, commonly referred to as HVAC systems 32, or other structures that protrude above the roof line of a commercial building and detract from the aesthetics thereof.

The mounting units 22 are spatially positioned along the screen 24, such that at least one mounting unit 22 is attached to each panel 30, for securing the screen 24 to the roof 26. In the preferred embodiment, the panels 30 are provided with a weather resistant coating for maintaining the aesthetics of the roof screen 24. The weather resistant coating preferably comprises a commercially available Polyvinylidene fluoride, such as KYNAR, manufactured by Pennwalt Corporation, Pa.

Figure 5:
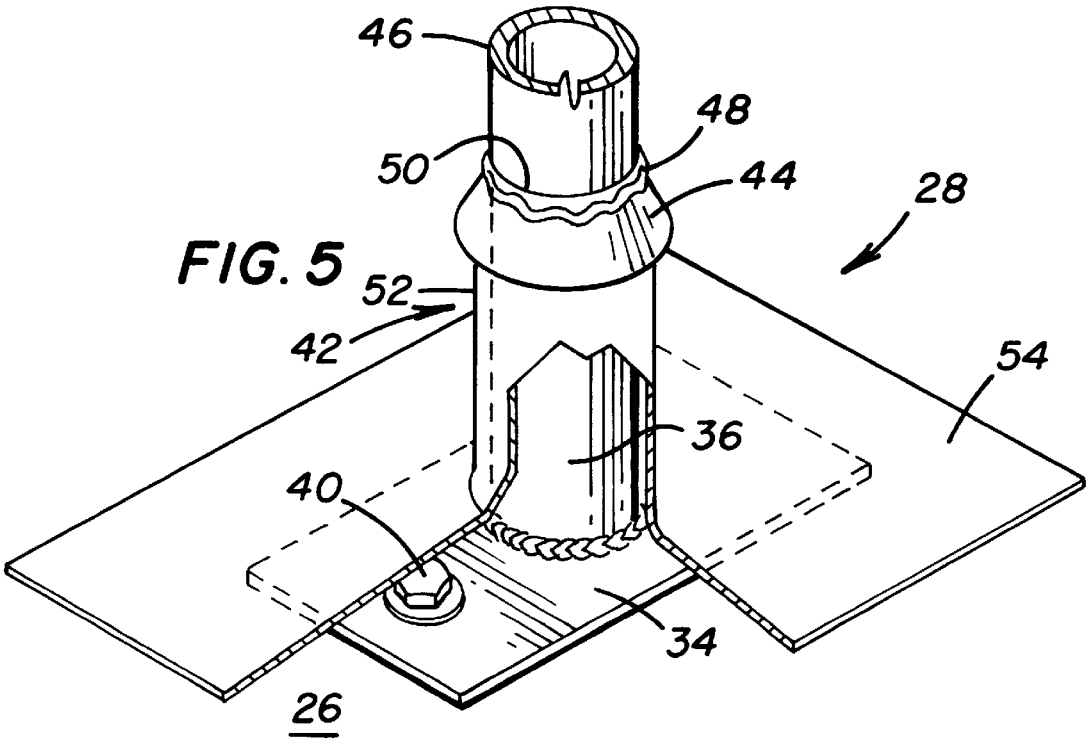
FIG. 5 is a partial cutaway, perspective view of the preferred embodiment of the support of the present invention.

Referring now to FIGS. 3–5, in the system of the present invention 20, each mounting unit 22 is secured to the roof 26 by means of the supports 28. Preferably, each of the supports 28 comprises a flat base plate 34 that is adapted to be secured to the roof 26 and a vertical member 36 affixed to the base plate 34. The vertical member 36 is preferably provided with an aerodynamic shape to inhibit the collection of debris about the support 28, due to wind forces for example, to inhibit damage to the roof 26 for maintaining roof integrity. The flat base 34 additionally aids with preventing debris from collecting about the support 28. In the preferred embodiment, the vertical member 36 is provided with a cylindrical cross-sectional configuration, although other suitable shapes may be utilized. The vertical member 36 is preferably fabricated from galvanized steel pipe that is approximately 3/16 inch thick and 1½ inch in diameter.

The base plate 34 is preferably fabricated from galvanized steel plate that is approximately ¼ inch thick and may be of desired widths. The vertical member 36 is affixed to the base plate 34 using well known methods, such as welding. Holes 38 are formed though the base plate 34 for receiving suitable means, such as lag bolts 40. The bolts 40 are threaded into the roof 26 for attaching the base plate 34 to the roof 26, to secure the support 28 to the roof 26.

A weatherproofing assembly 42 is disposed about the vertical member 36 and base plate 34 of each support 28 to prevent the roof 26 from leaking, due to mounting of the supports 28 on the roof 26, such as by leaks that may be caused due to disposing the bolts 40 through the roof 26 (shown in FIG. 3). The weatherproofing assembly 42 preferably comprises a downwardly and outwardly extending collar 44 that extends about the vertical member and is secured thereto proximal to an upper end 46 of the vertical member 36. A waterproof sealant 48 is disposed about a junction 50 of the vertical member 36 and collar 44 to prevent water from passing therebetween. The collar 44 directs water away from the vertical member 36 to prevent water from flowing down the member 36 and on to the base plate 34 of the support 28 to prevent the roof 26 from leaking. In the preferred embodiment 20, the collar comprises a waterproof polymeric material, such as a commercially available rubber, while the sealant 48 may comprise any appropriate commercially available urethane sealant.

The weatherproofing assembly 42 further includes a body portion 52 that extends beneath the collar 44 and may be coupled thereto. The body 52 extends from the collar 44 along the length of the vertical member 36 to the base plate 34. The body 52 is preferably configured complementary to the member 36, for maintaining the aerodynamic shape thereof. A base cover 54 may be integrally formed with the body portion 52, such that the base cover 54 and body portion 52 comprise a unitary portion of a suitable waterproof material. In the preferred embodiment, the base cover 54 and body portion 52 are fabricated from a suitable malleable, waterproof metal alloy, such as lead, that is well known in the roofing trades.

The base cover 54 is configured to extend outwardly from the vertical member 36 enclosed by the body 52 and extend over the base plate 34, for covering the base 34, and thus prevent water from contacting the holes 38 formed through the base 34 and potentially causing the roof 26 to leak. The cover 54 is preferably dimensioned to extend beyond the periphery of the base 34 and over a region 56 of the roof 26 adjacent to the base 34, to prevent the roof 26 from leaking due to water collection on the weatherproofing assembly 42 and on and about the support 28. Thus, the weatherproofing assembly 42 aids with maintaining roof integrity, and particularly aids with preventing the roof 26 from leaking.

Referring now to FIGS. 3, 4, and 6, and particularly to FIG. 3, each mounting unit 22 of the preferred embodiment of the roof screen system 20 of the present invention comprises a plurality of elongated braces including a base brace 58, a vertical brace 60, and a diagonal brace 62. Each of the braces 58, 60, 62 comprise elongated portions of angle iron that are fabricated using a galvanized metal alloy, such as galvanized steel. In the preferred embodiment, the base brace 58 comprises ¼ angle iron, while the vertical and diagonal braces 60, 62 comprise ⅛ angle iron. The braces 58, 60, 62 are coupled together using appropriate methods, such as welding.

The mounting units 22 are formed by coupling the base brace 58 to the upper end 46 of each of a pair of supports 28 that are secured to the roof 26 for securing the mounting unit to the roof 26. The base brace 58 is coupled to the supports 28 by welding for example. A lower end 64 of the vertical brace 60 is affixed to an outer end 66 of the base brace 58, so that the vertical brace 60 extends perpendicularly to the roof 26. The diagonal brace 62 has a lower end 68 affixed to an inner end 70 of the base brace 58 and has a screen end 72 affixed to an upper end 74 of the vertical brace 60. The diagonal brace 62 is affixed to the base brace 58 and vertical brace 60 at approximately 45° angles so that the brace 62 extends substantially obtusely between the two braces 58, 60 for forming a triangular relationship therebetween. The triangular relationship of the braces 58, 60, 62 enhances the structural integrity of the mounting unit 22 to positively support a roof screen panel 30 coupled to the vertical brace 60 and to the unit 22. Since the braces 58, 60, 62 comprise a strong and lightweight, and weather resistant material, the mounting units 22 of the present invention to increase the life of the invented system 20, while preventing the mounting units 22 from failing in the presence of extreme natural forces, such as wind and seismic forces.

Referring again to FIG. 3, and FIG. 6, the vertical brace 60 is preferably provided with means for securing the roof screen panels 30, and thus the roof screen 24 to the mounting unit 22, to secure the roof screen 24 to the roof 26. A plurality of mounting means, such as standoffs or washers 76 extend between the vertical brace 60 and panel 30. Known securing means such as self drilling screws (not shown) for example, are disposed through the panels 30 and though the standoffs 76 and extend into the brace 60 for coupling the panel 30 to the brace 60, and thus securing the screen 24 to the mounting unit 22.

Thus, there has been described an improved roof screen system for securing a roof screen to a roof. The system includes a weatherproofing assembly that is disposed about each support to prevent the roof from leaking, due to mounting of the supports on the roof. The cylindrical configuration of the support and weatherproofing assembly coact to prevent water and debris from collecting about the support and its base, to aid with maintaining roof integrity and to prevent the roof from leaking. Each mounting unit comprises a plurality of braces affixed in a triangular relationship. The braces comprise a strong, lightweight, and weather resistant material to prolong the life expectancy of the invented system and to prevent the mounting units from failing in the presence of natural forces, such as wind and earthquakes.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A system for supporting a roof screen on a roof, the system comprising:

a plurality of mounting units adapted to be coupled to the roof screen for supporting the screen;

a plurality of supports, at least one support supporting each mounting unit, each support for attaching to the roof and secured to the mounting unit for coupling the unit to the roof to support the screen;

a plurality of weatherproofing assemblies, one weatherproofing assembly disposed about each support for covering the support, the weatherproofing assemblies preventing the roof from leaking due to water collection on the support; and each of the supports comprising a base plate adapted to be attached to the roof and a vertical cylindrical member affixed to the base plate to support the mounting unit secured thereto a selected distance above the roof, the cylindrical configuration of the vertical member providing an aerodynamic shape to inhibit the collection of debris about the support to inhibit damage to the roof for maintaining roof integrity.

2. The system of claim 1 wherein each of the weatherproofing assemblies comprises:

a collar extending about the vertical member for preventing water from flowing down the member, the collar secured to the vertical member proximal to an upper end thereof;

a body portion coupled to the collar and extending from the collar along the vertical member to the base plate, the body portion configured complementary to the vertical member for maintaining the aerodynamic shape thereof; and a base cover coupled to a lower end of the body portion, the base cover dimensioned to extend outwardly from the vertical member and over the base plate covering the plate, the weatherproofing assembly comprising waterproof materials for preventing the roof from leaking due to water collection on the assembly and on the support.

3. The system of claim 1 wherein each of the mounting units comprises a plurality of braces affixed in a selected angular relationship supporting the roof screen, the braces comprising a lightweight metal alloy to prevent the mounting units from failing in the presence of extreme natural forces including wind and seismic forces.

4. A system for supporting a roof screen on a roof, the system comprising:

a plurality of mounting units coupled to the roof screen for maintaining the screen in a desired angular relationship to the roof, each of the mounting units including a plurality of braces affixed together in a selected angular relationship for supporting the screen;

a plurality of supports, at least one support supporting each mounting unit, each support comprising a base plate for securing to the roof and a vertical cylindrical member for affixing to the base plate and coupled to a base brace of the mounting unit for positively securing the unit to the roof, the configuration of the vertical member inhibiting the collection of debris about the support to inhibit damage to the roof; and a plurality of weatherproofing assemblies, one weatherproofing assembly disposed about each support covering the support, each weatherproofing assembly including a base cover extending outwardly from the vertical member, over the base plate covering the plate, and extending beyond the periphery of the base plate and over a region of the roof adjacent to the base plate, each weatherproofing assembly comprising waterproof materials for preventing the roof from leaking due to water collection on the assembly and on and about the support.

5. The system of claim 4 wherein the cylindrical configuration of the vertical member provides an aerodynamic shape to inhibit the collection of debris about the support to inhibit damage to the roof for maintaining roof integrity.

6. The system of claim 4 wherein a pair of supports are provided for each mounting unit for supporting the unit.

7. The system of claim 4 wherein each of the weatherproofing assemblies comprises:

a downwardly and outwardly extending collar extending about the vertical member and secured to an upper end thereof proximal to the base brace coupled to the member, the collar directing water away from the length of the vertical member to prevent water from flowing down the member and on to the base plate coupled thereto to prevent the roof from leaking; and a body portion coupled to the collar and extending from the collar along the length of the vertical member to the base plate, the body portion configured complementary to the vertical member for maintaining the aerodynamic shape thereof.

8. The system of claim 7 wherein the body portion and base cover comprise a malleable, waterproof metal alloy.

9. The system of claim 8 wherein the metal alloy comprises lead.

10. The system of claim 7 wherein the collar comprises a waterproof, polymeric material and wherein a waterproof sealant is disposed about a junction of the vertical member and collar to prevent water from passing therebetween and along the length of the member and on to the base plate of the support to prevent the roof from leaking.

11. The system of claim 4 wherein each of the plurality of mounting units comprises:

a plurality of elongated braces including a base brace, a vertical brace, and a diagonal brace, the base brace coupled to a pair of supports for securing to the roof for securing the mounting unit to the roof, a lower end of the vertical brace affixed to an outer end of the base brace, and the diagonal brace affixed to an inner end of the base brace and to an upper end of the vertical brace, such that the diagonal brace extends obtusely between the braces forming a triangular relationship therebetween, the triangular relationship of the braces enhancing the structural integrity of the mounting unit to positively support a roof screen coupled to the vertical brace and to the unit.

12. The system of claim 11 wherein each of the braces preferably comprises a strong, lightweight, and weather resistant metal alloy to prolong the life expectancy of the mounting unit and to prevent the mounting units from failing in the presence of extreme natural forces including wind and seismic forces.

13. The system of claim 12 wherein each of the braces comprises elongated portions of angle iron comprising galvanized steel.

14. The system of claim 11 wherein the system further comprises:

the roof screen comprising a plurality of screen panels adapted to be coupled together, the plurality of mounting units spatially positioned along the roof screen, with at least one mounting unit coupled to each screen panel comprising the screen, for coupling the screen to the roof, and the vertical brace of each mounting unit provided with means for securing a roof screen panel to the brace for coupling the screen to the plurality of mounting units for supporting the screen.

15. The system of claim 14 wherein the screen panels are provided with a weather resistant coating for maintaining the aesthetics of the roof screen.

16. The system of claim 15 wherein the weather resistant coating comprises a Polyvinylidene fluoride.

* * * * *